US009944880B2

(12) United States Patent
Ikeda et al.

(10) Patent No.: US 9,944,880 B2
(45) **Date of Patent: *Apr. 17, 2018**

(54) OIL-FREE SCREW COMPRESSOR COATED WITH A BASE RESIN, A SOLID LUBRICANT AND A HEAT-RESISTANT ADDITIVE

(71) Applicants: Hitachi Industrial Equipment Systems, Co., Ltd., Chiyoda-ku, Tokyo (JP); Kawamura Research Laboratories, Inc., Meguro-Ku, Tokyo (JP)

(72) Inventors: Yukiko Ikeda, Kasumigaura (JP); Kazuaki Shiinoki, Yokohama (JP); Masakatsu Okaya, Shizuoka (JP); Natsuki Kawabata, Shizuoka (JP); Masahiro Kawamura, Tokyo (JP); Iwao Aoki, Konosu (JP)

(73) Assignees: HITACHI INDUSTRIAL EQUIPMENT SYSTEMS CO., LTD., Tokyo (JP); KAWAMURA RESEARCH LABORATORIES, INC., Tokyo (JP)

( * ) Notice: Subject to any disclaimer, the term of this patent is extended or adjusted under 35 U.S.C. 154(b) by 173 days.

This patent is subject to a terminal disclaimer.

(21) Appl. No.: 14/325,083

(22) Filed: Jul. 7, 2014

(65) Prior Publication Data

US 2014/0322058 A1 Oct. 30, 2014

Related U.S. Application Data

(63) Continuation of application No. 13/248,110, filed on Sep. 29, 2011, now Pat. No. 8,801,412.

(30) Foreign Application Priority Data

Oct. 26, 2010 (JP) ..... 2010-239741

(51) Int. Cl.
*F01C 21/00* (2006.01)
*F03C 2/00* (2006.01)
(Continued)

(52) U.S. Cl.
CPC ..... *C10M 169/04* (2013.01); *F01C 1/14* (2013.01); *F04C 18/084* (2013.01); *F04C 18/16* (2013.01);
(Continued)

(58) Field of Classification Search
CPC ..... C10M 169/04; F04C 18/084; F04C 18/16; F04C 2230/91; F04C 2280/04; F05C 2225/10; F05C 2251/14; F01C 1/14
(Continued)

(56) References Cited

U.S. PATENT DOCUMENTS 7,718,247 B2 5/2010 Takeda et al.
8,075,293 B2 12/2011 Ouwenga
(Continued)

FOREIGN PATENT DOCUMENTS

CN 101336310 A 12/2008
JP 04-202470 7/1992
(Continued)

OTHER PUBLICATIONS

JP Office Action of Appln. No. 2010-239741 dated Jul. 23, 2013 with partial English translation.
(Continued)

*Primary Examiner* — Theresa Trieu
(74) *Attorney, Agent, or Firm* — Baker Botts L.L.P.

(57) ABSTRACT

In order to prevent deterioration in performance of an oil-free screw compressor and scuffing caused by rust, surfaces of both male and female rotors are coated with heat-resistance coatings containing a solid lubricant. A coating contains Polyimide resin to which Molybdenum disul-
(Continued)

fide, as a solid lubricant, and Aluminum oxide and Titanium oxide, as additives, are added. Accordingly, it is possible to realize a coating that is higher in heat resistance and longer in lifetime than a conventional one.

19 Claims, 7 Drawing Sheets

(51) Int. Cl.

| | |
|---|---|
| ***F03C 4/00*** | (2006.01) |
| ***F04C 2/00*** | (2006.01) |
| ***F04C 15/00*** | (2006.01) |
| ***C10M 169/04*** | (2006.01) |
| ***F04C 18/08*** | (2006.01) |
| ***F04C 18/16*** | (2006.01) |
| ***F01C 1/14*** | (2006.01) |

(52) U.S. Cl.
CPC ..... *F04C 2230/91* (2013.01); *F04C 2280/04* (2013.01); *F05C 2225/10* (2013.01); *F05C 2251/14* (2013.01)

(58) Field of Classification Search
USPC ..... 418/179, 201.1, 178
See application file for complete search history.

(56) References Cited

U.S. PATENT DOCUMENTS

| | | | | |
|---|---|---|---|---|
| 2002/0044870 | A1* | 4/2002 | Simonetti | F01D 5/28 416/221 |
| 2004/0224856 | A1* | 11/2004 | Saiki | C09D 179/08 508/108 |
| 2009/0119785 | A1 | 5/2009 | Challener et al. | |
| 2009/0136747 | A1 | 5/2009 | Kikuchi | |
| 2009/0169404 | A1* | 7/2009 | Sindt | F04C 2/1073 418/48 |
| 2009/0254286 | A1 | 10/2009 | Tulyani et al. | |
| 2009/0311476 | A1 | 12/2009 | Stetina et al. | |
| 2010/0003157 | A1 | 1/2010 | Scholl et al. | |
| 2010/0038142 | A1 | 2/2010 | Snyder et al. | |
| 2010/0227141 | A1 | 9/2010 | Morales | |

FOREIGN PATENT DOCUMENTS

| | | |
|---|---|---|
| JP | 07-166182 | 6/1995 |
| JP | 3267814 | 1/2002 |
| JP | 3740178 | 11/2005 |

OTHER PUBLICATIONS

Second Office Action of the SIPO, Application No. 201110287935.9 dated Jul. 11, 2014.

* cited by examiner

A: BASE RESIN 50～70wt%
B: SOLID LUBRICANT 15～35wt%
C: ADDITIVE 5～15wt%

OIL-FREE SCREW COMPRESSOR COATED WITH A BASE RESIN, A SOLID LUBRICANT AND A HEAT-RESISTANT ADDITIVE

CROSS-REFERENCE TO RELATED APPLICATIONS

This application is a continuation of U.S. patent application Ser. No. 13/248,110, filed Sep. 29, 2011, the entire contents of which are hereby incorporated by reference, which claims the benefit of Japanese Patent Application No. 2010-239741, filed Oct. 26, 2010, the entire contents of which are hereby incorporated by reference.

BACKGROUND OF THE INVENTION (1) Field of the Invention

The present invention relates to a screw compressor in which surfaces of rotors are processed.

(2) Description of the Related Art

In a screw compressor, a pair of a male rotor and a female rotor is rotated while being meshed with each other in a casing, and fluid in spaces formed of the casing and the both rotors is compressed while the spaces are allowed to move in the axis direction to be decreased.

There are an oil-cooling screw compressor in which oil as fluid is supplied into a casing and an oil-free screw compressor in which no oil is supplied into a casing.

In the oil-cooling screw compressor, a male rotor and a female rotor are rotated while being brought into contact with each other through oil films. The oil-cooling screw compressor can prevent seizure of the rotors by cooling friction heat generated by rotation of the rotors using the oil.

The oil-cooling screw compressor is not suitable for use in fields such as the food industry and the semiconductor-related industry where clean air is required because oil mist is mixed with compressed air.

On the other hand, oil is not used at all in the oil-free screw compressor, and thus clean air can be supplied. However, both rotors are rotated in a non-contact state so as not to cause seizure of the rotors due to no seals of oil. Therefore, synchronous gears are attached to shaft ends of the rotors to apply rotational force to the rotors in the oil-free screw compressor. Thus, the structure of the oil-free screw compressor is complicated as compared to that of the oil-cooling screw compressor.

Further, the rotors are rotated in a non-contact state in the oil-free screw compressor. Thus, compressed air flows back to the suction side from gaps between both rotors or between the rotors and a rotor casing to possibly cause adverse effects on the performance of the screw compressor. Therefore, it is necessary for the oil-free screw compressor to minimize the sizes of the gaps between both rotors or between the rotors and the rotor casing in a non-contact state in order to improve performances such as volumetric efficiency. In fact, it is impossible to completely realize a non-contact state due to thermal expansion, mechanical processing errors, and the like. Thus, it is essential to provide a solid lubricating function for the rotor surfaces.

Therefore, coatings are generally applied on the rotor surfaces of the oil-free screw compressor. By providing the coatings on the rotor surfaces, scuffing or seizure can be prevented, and the sizes of the gaps between both rotors or between the rotors and the rotor casing can be reduced even if the rotor surfaces are brought into contact with each other due to complicated thermal expansion during operations, mechanical processing errors, and the like. Therefore, the coating has lubricity, heat resistance, and rust prevention (refer to Japanese Patent Nos. 3267814 and 3740178).

Differences in temperature and pressure between the suction side and the discharge side of the rotors become large in the oil-free screw compressor because there is no medium for cooling friction heat unlike the oil-cooling screw compressor.

The air sucked at substantially at room temperature is compressed to 800 kPa by rotation of the screw. The temperature of the compressed air reaches as low as 260° C. and as high as 360° C. when being discharged by adiabatic compression. Thus, high heat-resistance is required for the coatings applied to the rotor surfaces exposed to the high-temperature air. The coatings are degraded by heat and are separated by contact and sliding of the rotors. Alternatively, the coatings are gradually degraded, separated, and dropped by being exposed to high temperatures for a long period of time.

As described above, if the coatings are separated, the gaps between the both rotors or between rotors and the rotor casing are widened, and the air leaks from the gaps, resulting in deterioration in performance. The leaked air is compressed by rotation of the screw, and the temperature of the air further rises. As described above, if the air leaks, the performance is deteriorated, and the discharge temperature further rises, resulting in a vicious circle.

Further, when the operation of the compressor is stopped, the high-temperature compressed air is cooled to generate dew condensation by condensation of moisture in the air, and moisture possibly adheres to the inside of the compressor. In this case, if the coatings are separated and a base metal portion is exposed, there is a high possibility that the portion tarnishes due to the dew condensation. The rust generated when the operation is stopped causes scuffing at the time of actuating the compressor for the next time and failures of the compressor.

Further, demand for maintenance-free has recently been high for the oil-free screw compressor, and thus development of high-performance and long-life coatings has been required. Therefore, it has been necessary to prevent deterioration in performance of the oil-free screw compressor and scuffing caused by rust by improving the heat resistance of the coatings that is intimately related to degradation and separation of the coatings.

An object of the present invention is to provide a screw compressor including screw rotors with coatings having high solid lubricity and heat resistance.

SUMMARY OF THE INVENTION

The above-described object is achieved by an oil-free screw compressor that sucks and discharges fluid by combining a male rotor and a female rotor on outer surfaces of which spiral profiles are formed in the axis direction, wherein solid lubrication heat-resistance coatings are formed on the surfaces of the male and female rotors while resin containing an imide bond is used as base resin and Molybdenum disulfide, as a solid lubricant, Aluminium oxide, and Titanium oxide are dispersed in the resin, and the male and female rotors coated with the solid lubrication heat-resistance coatings are provided.

Further, the above-described object is achieved in such a manner that the resin has an imide bond, and the solid lubrication heat-resistance coatings containing a solid lubricant and additives in which the resin is Polyamideimide resin are formed.

Further, the above-described object is achieved in such a manner that the resin has an imide bond, and the solid lubrication heat-resistance coatings containing a solid lubricant and additives in which the resin is Polyimide resin are formed.

Further, the above-described object is achieved by including the male and female rotors coated with the solid lubrication heat-resistance coatings formed by combining: 15 to 35 wt % of Molybdenum disulfide as the solid lubricant; 4 to 14 wt %, in total, of Aluminium oxide and Titanium oxide at a ratio of 3:7 to 7:3 as the additives; and at least 50 wt % or higher of resin containing an imide group for binding these compounds.

Further, the above-described object is achieved by further adding 1.5 to 3.5 wt % of a rust prevention pigment to the solid lubrication heat-resistance coatings.

Further, the above-described object is achieved by further adding 0.5 to 2.5 wt % of Talc to the solid lubrication heat-resistance coatings.

Further, the above-described object is achieved by an oil-free screw compressor that sucks and discharges fluid by combining a male rotor and a female rotor on outer surfaces of which spiral profiles are formed in the axis direction, wherein there are provided the male and female rotors on the surfaces of which solid lubrication heat-resistance coatings formed by dispersing Molybdenum disulfide, as a solid lubricant, Titanium oxide, and Silicon nitride in resin containing an imide bond used as base resin are applied.

Further, the above-described object is achieved by including the male and female rotors coated with the solid lubrication heat-resistance coatings formed by combining: 15 to 35 wt % of Molybdenum disulfide; 8 to 15 wt %, in total, of Titanium oxide and Silicon nitride at a ratio of 4:6 to 7:3; and at least 50 wt % or higher of resin containing an imide group for binding these compounds.

According to the present invention, a screw compressor including screw rotors coated with coatings having high solid lubricity and heat resistance can be provided.

DETAILED DESCRIPTION OF THE EMBODIMENT

There are two kinds of screw compressors, namely, a double-stage screw compressor and a single-stage screw compressor. This is associated with the discharge temperature of the screw compressor. In the double-stage screw compressor, two screw compressors are connected to each other in a series through a pipe and a cooler. High-temperature discharge gas discharged from the first compressor is cooled by the cooler that uses the outside air or water as refrigerant, and then the cooled gas is compressed again by the second compressor. Accordingly, the temperature of the discharge gas is cooled once, and thus the temperature of the discharge gas from the second compressor can be lowered.

On the contrary, the single-stage screw compressor is extremely advantageous in terms of cost performance because of one compressor. However, the discharge temperature reaches as high as 360° C. Thus, there has been an urgent need to develop coatings for male and female rotors resistance to high temperatures for the single-stage screw compressor for which demand for maintenance-free is high. As a result of various examinations by the inventors, the following embodiment was obtained.

Hereinafter, the embodiment of the present invention will be described in accordance with the drawings. However, a structure of a general oil-free screw compressor will be described using FIGS. 1, 2, and 3 before describing the embodiment.

Figure 1:
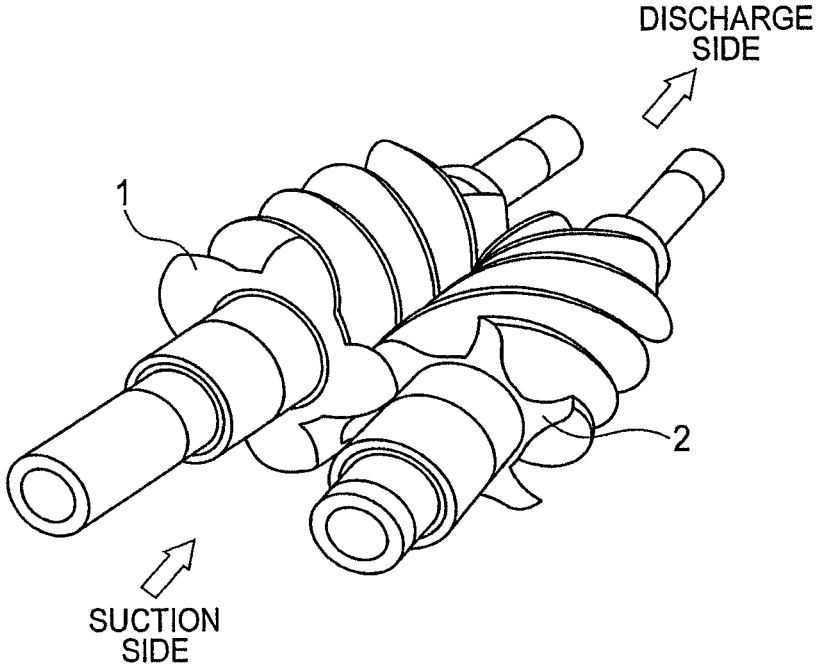
FIG. 1 is a perspective view for showing a state in which a male rotor and a female rotor mesh with each other.

FIG. 1 is a perspective view for showing a state in which a male rotor and a female rotor mesh with each other.

Figure 2:
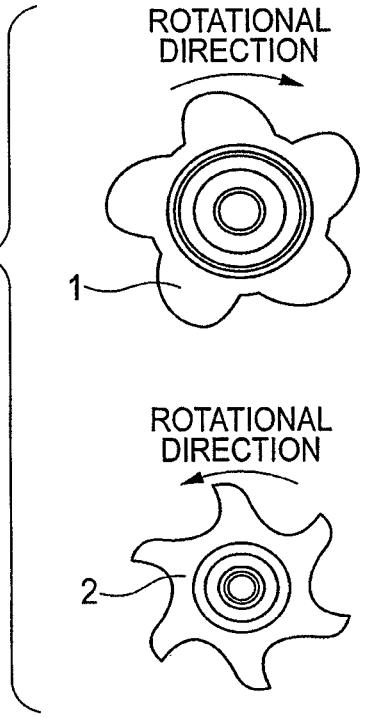
FIG. 2 are cross-sectional views for showing the shapes of the male rotor and the female rotor.

FIG. 2 are cross-sectional views for showing the shapes of the male rotor and the female rotor.

Figure 3:
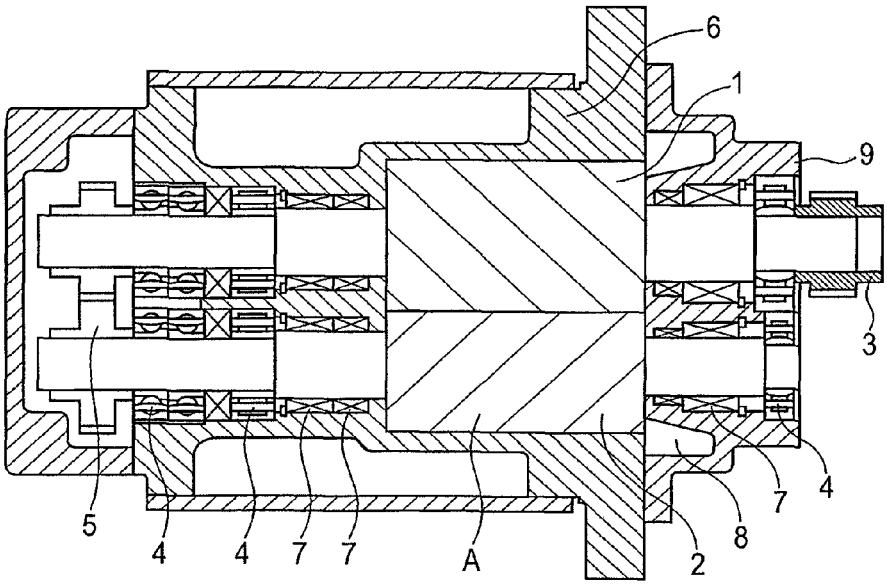
FIG. 3 is a cross-sectional view of the main body of an oil-free screw compressor.

FIG. 3 is a cross-sectional view of the main body of an oil-free screw compressor.

The present invention performs a coating process on surfaces of both the male and female rotors of the oil-free screw compressor shown in FIGS. 1 to 3, and is suitable particularly for the single-stage screw compressor.

In FIGS. 1 and 2, the screw compressor compresses air by allowing a male rotor 1 and a female rotor 2 to mesh with each other and to rotate. The main body of the compressor includes a casing 6 and an S-casing 9 that accommodate the male and female rotors 1 and 2. Synchronous gears 5, to be described later, are provided at end portions of the rotors in order to transmit the rotation between both rotors 1 and 2 and to maintain rotational phases. It should be noted that seals (to be described using FIG. 3) provided for rotor shafts are arranged so as to suppress air leaks from a compression chamber and to prevent lubricant oil supplied to bearings provided at the rotor shafts from entering the compression chamber. The male rotor 1 is rotated clockwise when viewed from the suction side as shown by the arrow, and the female rotor 2 is rotated counterclockwise when viewed from the suction side as shown by the arrow. In the case of the oil-free screw compressor, convex portions of the male rotor 1 and concave portions of the female rotor 2 mesh with each other in a non-contact state, and the male rotor 1 and the female rotor 2 are rotated by the synchronous gears 5.

In FIG. 3, the male rotor 1 and the female rotor 2 that mesh with each other are rotatably supported by bearings 4 at both end portions, and air leaks from a compression chamber A are prevented by seals 7. Further, the seals 7 prevent oil lubricating the bearings 4 from entering the compression chamber 4 formed of the casing 6 and the male and female rotors 1 and 2. In the compression chamber 4, the pair of male and female rotors 1 and 2 is not cooled by, for example, oil injection. The seals 7 seal portions between the rotor shafts that rotate and support the male and female rotors 1 and 2 and the compression chamber A formed of the casing 6 and the male and female rotors 1 and 2.

Further, a driving pinion 3 is fixed to one tip end of the male rotor 1, and the pair of synchronous gears 5 is fixed to the other tip end of the male rotor 1 and one tip end of the female rotor 2. Thus, when driving the driving pinion 3, the pair of synchronous gears 5 rotates the pair of male and female rotors 1 and 2 in synchronization to compress and discharge air sucked from a suction port 8. At this time, cooling oil is not fed between the pair of male and female rotors 1 and 2, and thus the surfaces of the pair of male and female rotors 1 and 2 are exposed to high-temperature air, resulting in a rise in temperature.

Specifically, the air is compressed in the following order.

1. Each of the grooves of the male rotor 1 is communicated with that of the female rotor 2 to form a V-shaped working chamber.
2. If both rotors are rotated in this state, the working chambers are moved in parallel from the suction end to the discharge end.
3. Each of the working chambers is formed in a shape closed by both ends of the rotors, and thus the volume of the working chamber facing one lateral face is gradually increased to reach the maximum volume across both lateral faces.
4. Thereafter, the working chamber faces the discharge-side face and the volume is gradually decreased.
5. The suction port 8 is opened for the S-casing 9 facing the working chamber whose volume is being increased, and thus gas is sucked from the suction port 8 to inside of the working chamber.
6. The inside of each working chamber is compressed without providing an opening in the early part of the course of a decrease in volume, and a discharge port that is opened from a position where the working chamber becomes a predetermined pressure to a position where the volume of the working chamber is decreased to discharge the compressed air.

With such a series of sucking and compressing operations, the sucked room-temperature air is compressed to 800 kPa by rotation of the screw. The temperature of the compressed air reaches as low as 260° C. and as high as 360° C. when being discharged. As a lock mechanism for the apparatus, the compressor is brought to an emergency stop when the temperature of the discharged air reaches 398° C.

As described above, there are two kinds of oil-free screw compressors, namely, the single-stage screw compressor in which air is compressed to a predetermined pressure by one compressor, and the double-stage screw compressor in which air compressed by the first compressor is taken out and cooled once, and then the cooled air is compressed to a predetermined pressure by the second compressor. As a cooling method by the double-stage screw compressor, the compressed air is cooled by a water-cooling method or an air-cooling method in accordance with the model and capacity. Therefore, a coating resistance to higher temperatures is advantageous in the single-stage screw compressor. As described above, the temperature of the air discharged from the single-stage oil-free compressor reaches 260° C. or higher unlike an oil-cooling compressor.

The oil-free screw compressor is designed according to the principle that the rotors are not mutually brought into contact with each other. Thus, a solid lubrication coating as an object of the present invention is improved in performance by reducing gaps provided between the rotors. Further, the solid lubrication coating prevents scuffing that occurs when the rotors are accidentally brought into contact with each other, and is provided for rust prevention while having a thickness of about 20 μm.

Next, results of comparing and examining constituent elements of the coating will be described.

In the first place, as resin serving as a base (hereinafter, referred to as base resin), resin resistance to higher temperatures is selected because the coatings are applied to the rotor surfaces whose temperatures reach 260° C. at the lowest, and 360° C. if assuming the highest temperature of the single-stage screw compressor. Resin containing an imide group was selected as heat-resistance resin that can be uniformly applied to complicated shapes such as the spiral screw rotors and that can be supplied in a solution-like varnish form.

The resin containing an imide group includes Polyamideimide resin, Polyimide resin, and the like. Polyamideimide resin is thermoplastic resin and can be supplied in a varnish form. Further, Polyimide can be also supplied in a varnish form if a Polyamic acid solution that is the precursor of Polyimide is used. When being blended as coating liquids, both are blended while being diluted with a proper solvent. A solid lubricant and additives for improving heat resistance are added to the resin solutions to form a coating.

It is necessary for such a composite material to be established as a material first.

Figure 4:
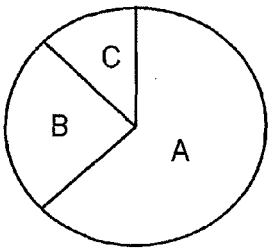
FIG. 4 is a diagram for explaining a composition ratio of a coating.

FIG. 4 is a diagram for showing a composition ratio of a coating remaining after the coating liquid is applied and the solvent is volatized.

In FIG. 4, 50 wt % or higher of the base resin is required. In the case of 50 wt % or lower, the coating is tattered because the solid lubricant and additives to be combined cannot be held, and the base resin cannot function as a coating. Further, if the ratio of the resin exceeds 70 wt %, the solid lubricant does not sufficiently function due to the predominant nature of the resin.

Further, it is desirable to add 15 to 35 wt % of the solid lubricant. The ratio varies depending on the ratio of compounded resin. Specifically, the solid lubricant most effectively functions when the compounded amount of the solid lubricant is 30 to 50% of the weight of the resin. In addition, as a remaining amount except the base resin and the solid lubricant, a few kinds of additives for improving heat resistance are added to be 100 wt % in total.

First Embodiment

An embodiment of the present invention will be described using FIGS. 5 to 12.

Additives that were possibly effective in heat resistance were examined in detail using a quality engineering method (for example, "Quality Engineering Course 1, Quality Engineering in development and design stage" Authors, Genichi Taguchi and Masataka Yoshizawa, Japanese Standards Association (1988)). The quality engineering used in this examination is a method to reduce variations of quality caused by various problems at a stage of manufacturing materials and to improve the function. The types and content of additives to be compounded in the coating were used as parameters in this examination to evaluate the heat resistacet of the coating with a thermal analysis device. The result can be obtained for each parameter in the quality engineering, and the factorial effect can be obtained for each additive in this examination. Thus, the coating can be designed with an optimum combination among them.

On the basis of the examination results, additives that were found to be effective in heat resistance will be described using FIGS. 5 to 12.

Figure 5:
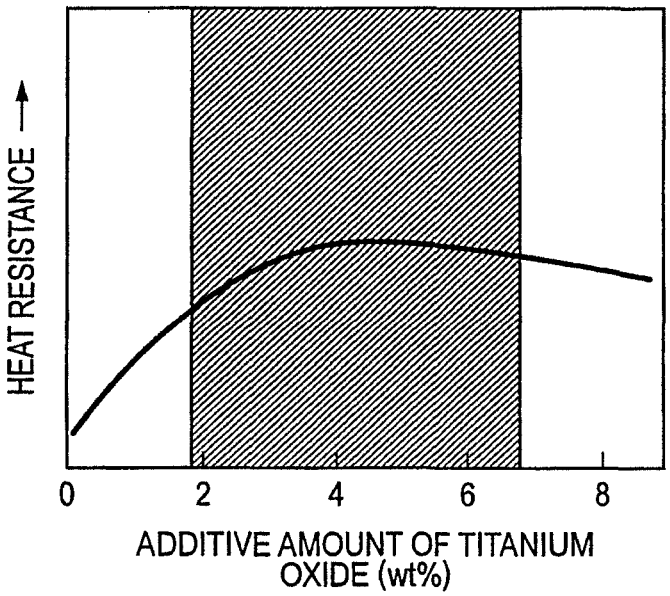
FIG. 5 is a graph for showing the effects of heat resistance associated with the additive amount of Titanium oxide.

FIG. 5 is a graph for showing effects of heat resistance associated with the additive amount of Titanium oxide.

Figure 6:
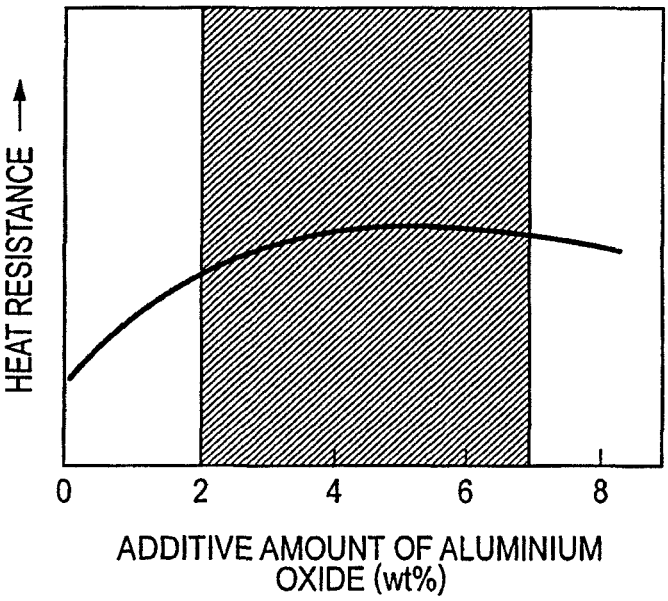
FIG. 6 is a graph for showing the effects of heat resistance associated with the additive amount of Aluminium oxide.

FIG. 6 is a graph for showing effects of heat resistance associated with the additive amount of Aluminium oxide.

Figure 7:
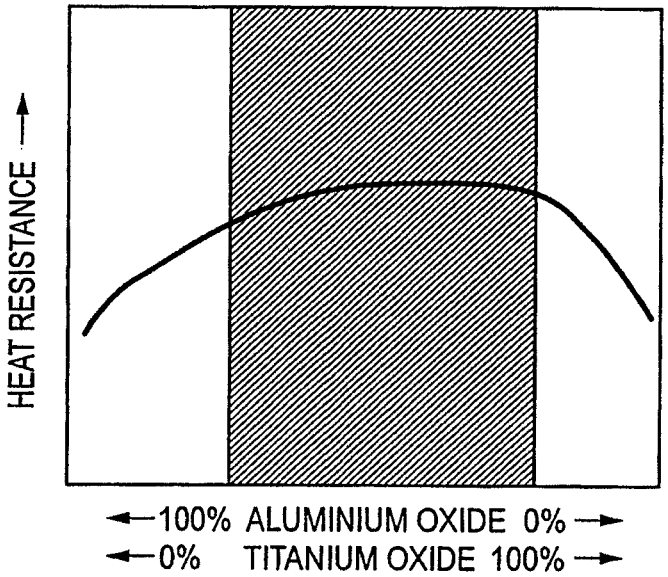
FIG. 7 is a graph for showing the effects of heat resistance associated with the compounded ratio of Aluminium oxide to Titanium oxide.

FIG. 7 is a graph for showing effects of heat resistance associated with the compounded ratio of Aluminium oxide to Titanium oxide.

Figure 8:
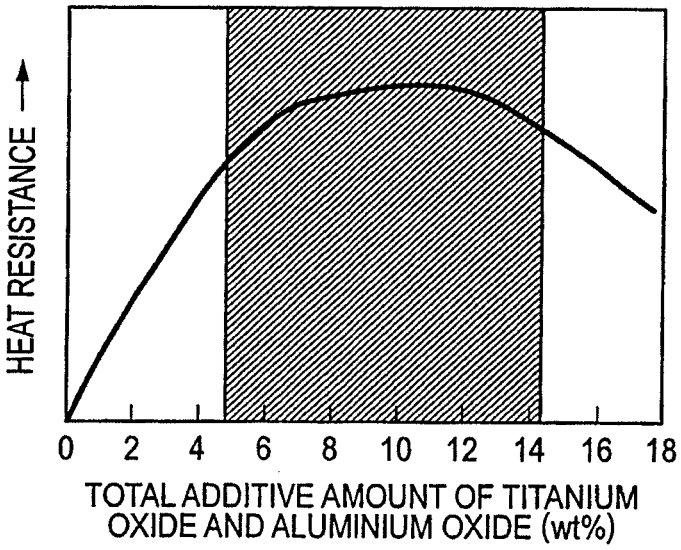
FIG. 8 is a graph for showing the effects of heat resistance associated with the total additive amount of Titanium oxide and Aluminium oxide.

FIG. 8 is a graph for showing effects of heat resistance associated with the total additive amount of Titanium oxide and Aluminium oxide.

Figure 9:
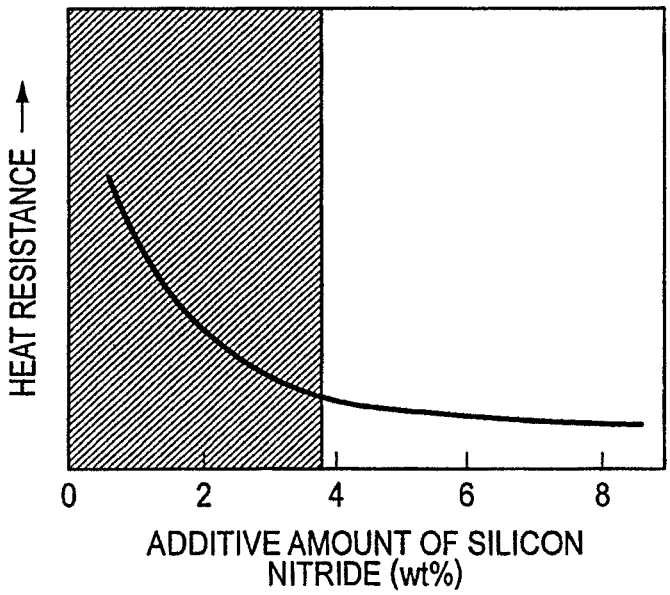
FIG. 9 is a graph for showing the effects of heat resistance associated with the additive amount of Silicon nitride.

FIG. 9 is a graph for showing effects of heat resistance associated with the additive amount of Silicon nitride.

Figure 10:
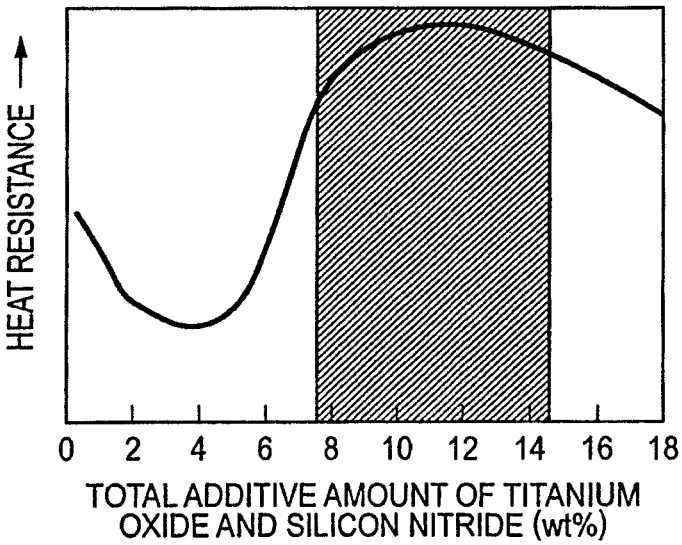
FIG. 10 is a graph for showing the effects of heat resistance associated with the total additive amount of Titanium oxide and Silicon nitride.

FIG. 10 is a graph for showing effects of heat resistance associated with the total additive amount of Titanium oxide and Silicon nitride.

Figure 11:
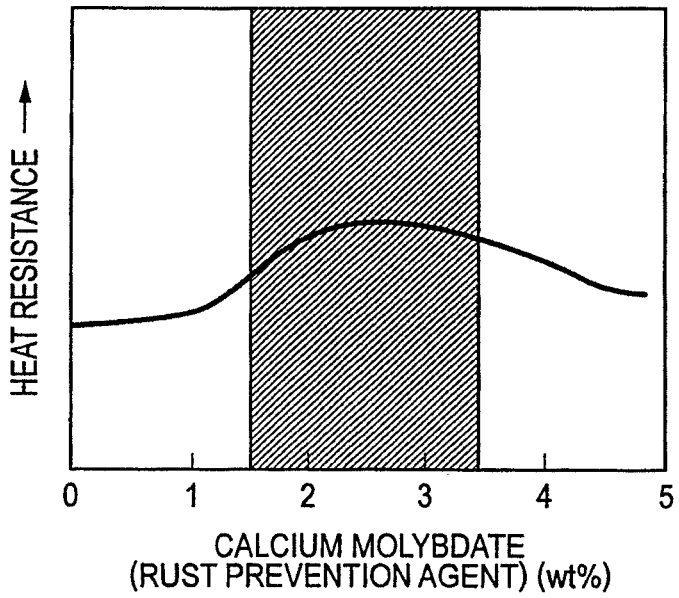
FIG. 11 is a graph for showing the effects of heat resistance associated with the additive amount of Calcium molybdate (rust prevention agent)

FIG. 11 is a graph for showing effects of heat resistance associated with the additive amount of Calcium molybdate (rust prevention agent).

Figure 12:
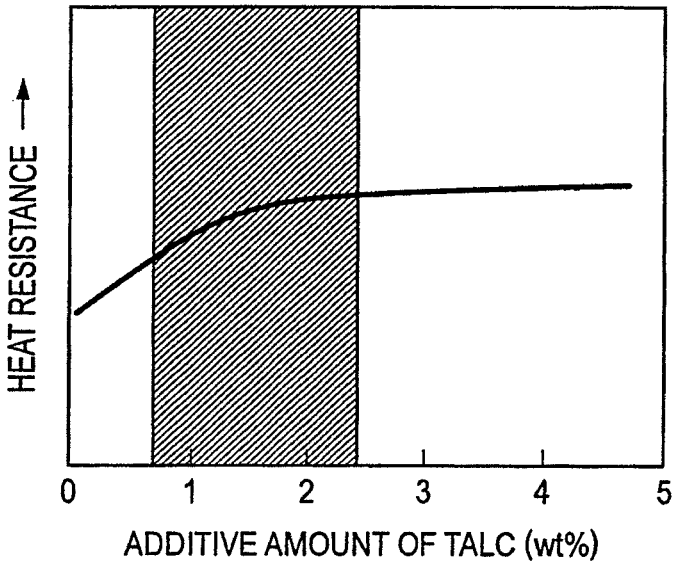
FIG. 12 is a graph for showing effects of the heat resistance associated with the additive amount of Talc.

FIG. 12 is a graph for showing effects of heat resistance associated with the additive amount of Talc.

As shown in FIGS. 5 to 8, it was found by the quality engineering method that additives highly effective in heat resistance were Titanium oxide and Aluminium oxide, and addition of 2 to 7 wt % of each was preferable. In addition, it was also found that addition of both further improved heat resistance by a synergetic effect. It was also found that the heat resistance effect was further exerted when 4 to 14 wt %, in total, of Aluminium oxide and Titanium oxide at a ratio of 3:7 to 7:3 was added.

Further, it was found, as shown in FIGS. 9 and 10, that excessively adding Silicon nitride leads to deterioration in heat resistance, but a combination with Titanium oxide exerted effects in some areas. It was found that an additive amount of 0 to 4 wt % of Silicon nitride was preferable and the heat resistance effect was exerted when 8 to 15 wt %, in total, of Silicon nitride and Titanium oxide was added.

It was confirmed that a rust prevention pigment (Calcium molybdate) for suppressing rust as shown in FIG. 11 had no adverse effect on heat resistance, and it was found that the rust prevention pigment was rather effective in improving heat resistance in a range of 1.5 to 3.5 wt %.

In addition, it was confirmed that Talc or the like as a minor component as shown in FIG. 12 was effective in a sliding property and had no adverse effect on heat resistance. It was found that addition of Talc in a minimum range of 0.5 to 2.5 wt % was preferable because the effect became constant if the ratio exceeded 2.5 wt %.

In such a composite material, it is necessary that the base resin binds and holds the materials established as raw materials, namely, the compounded materials other than the base resin to effectively fulfill these functions. Thus, in principle, minimum amounts of additives are added.

Therefore, as long as the similar effects can be obtained in heat resistance in FIGS. 5 to 12, it is desirable that the total content of additives with less additive amounts be 15 wt % or lower.

It should be noted that the additives selected in this examination were oxidative products and natural products that were generally used in various fields, and the coating can be called an environmentally-friendly coating because no chemical substances harmful to environments according to environment-related regulations are contained.

TABLE 1

| Composition ratio of examination coating (wt %) | | | | | | | | | | |
|---|---|---|---|---|---|---|---|---|---|---|
| | | Solid lubricant | additive | | | | | Evaluation test | | |
| Examination coating | Base resin | Molybdenum disulfide | Titanium oxide | Aluminium oxide | Silicon nitride | rust prevention agent | Talc | Heat resistance | lubricity | Rust preventive |
| 1 | PI 62 | 28 | 5 | 5 | 0 | 0 | 0 | ○ | ◎ | ○ |
| 2 | PI 68 | 22 | 5 | 5 | 0 | 0 | 0 | ○ | ◎ | ○ |
| 3 | PI 64 | 23 | 5 | 5 | 0 | 3 | 0 | ◎ | ○ | ◎ |
| 4 | PI 62 | 25 | 5 | 5 | 0 | 2 | 1 | ◎ | ○ | ◎ |
| 5 | PI 62 | 23 | 5 | 5 | 0 | 3 | 2 | ◎ | ○ | ◎ |
| 6 | PI 60 | 30 | 5 | 0 | 5 | 0 | 0 | ○ | ◎ | ○ |
| 7 | PAI 60 | 30 | 5 | 5 | 0 | 0 | 0 | Δ | ◎ | Δ |
| 8 | PAI 64 | 23 | 5 | 5 | 0 | 3 | 0 | Δ | ◎ | ○ |
| Conventional coating | PAI 60 | 24 | Additives other than above: two kinds and 16 in total | | | | | Δ X | ○ | Δ |

PI: Polyimide resin
PAI: Polyamideimide resin

On the basis of the examination of the elements, coatings with compounded ratios shown in Table 1 were produced. A conventional coating was produced by adding Antimony trioxide and graphite to Molybdenum disulfide while using Polyamideimide resin as the base resin. The examination coatings were compared with the conventional coating. The heat resistance was compared by a thermal analysis device, the lubricity was compared by a Pin-On-Disk sliding test, and rust preventive was compared using the amounts of rust generated in a test under a high temperature and high humidity environment.

It is obvious that changing the base resin to the Polyimide resin improves heat resistance. However, it was confirmed that use of the Polyamideimide resin improved the lubricity while having heat resistance same as the conventional coating. Further, it was confirmed that addition of the rust prevention agent improved rust prevention, and these additives had no effects on heat resistance but were rather effective in improving heat resistance.

Figure 13:
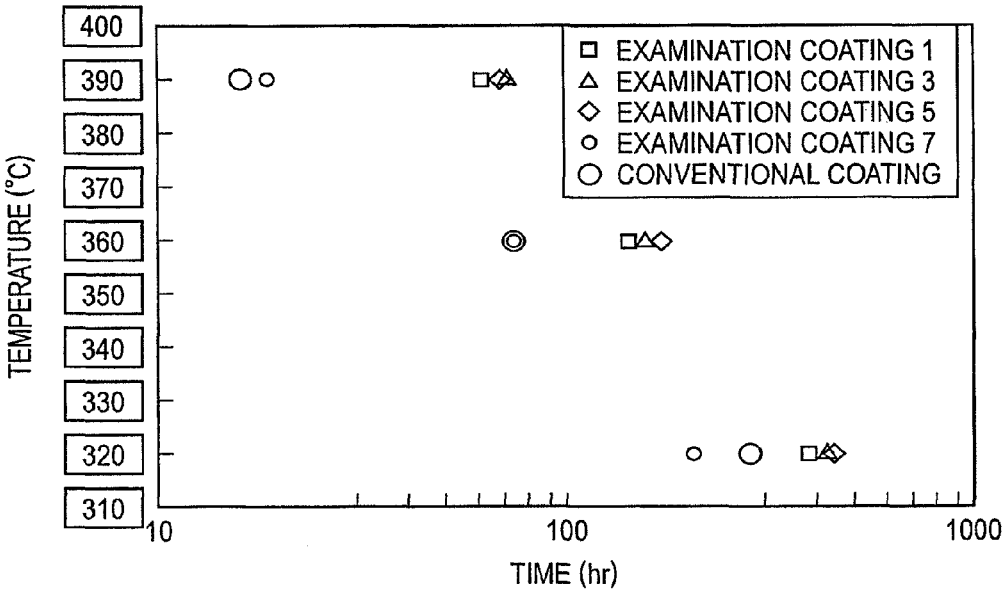
FIG. 13 is a graph for showing heat resistance evaluation results of examination coatings.

Results obtained by selecting a few kinds of coatings among those shown in Table 1 and evaluating the lifetimes of the coatings with a thermal analysis device are shown in FIG. 13.

FIG. 13 is a graph for showing heat resistance evaluation results of the examination coatings.

FIG. 13 shows a period of time until the coatings were degraded after the coatings were exposed under constant temperature environments (320° C., 360° C., and 390° C.). The degradation of each coating is determined using an index indicating thermal decomposition of a certain amount of a coating resin part. The rotors of an actual compressor, especially those on the discharge side where the temperatures rise are continuously operated until the coatings are further degraded as compared to the states indicated by the index in this examination. If a coating having the same thermal history is observed with a scanning electron microscope, the solid lubricant and additives adhere in a powder form.

As being apparent from FIG. 13, it can be found that the examination coatings according to the embodiment of the present invention are more effective in heat resistance in an environment where the temperatures are much higher. It can be found that the examination coating using Polyimide resin as the base resin has a lifetime twice the conventional coating at high temperatures, and six times the conventional coating at 390° C. Internal leaks of the compressed air at a part on the discharge side where the temperature rises directly lead to deterioration of performance or an abnormal discharge temperature of the screw compressor. Therefore, the coating of the present invention whose lifetime is extended at high temperatures is advantageous in improving the performance of the compressor.

As described above, the screw rotors coated with the solid lubrication heat-resistance coatings according to the present invention can be improved in heat resistance while keeping the lubricity of the coatings by optimizing a combination and compounded ratio of additives. Thus, separation due to the degradation of the coatings hardly occurs. Thus, an optimum gap between the screw rotors can be always maintained, leading to no deterioration in performance. Further, generation of rust can be suppressed to prevent scuffing.

What is claimed is:

1. A solid lubrication heat resistant coating comprising:
50 to 70 wt % of a base resin containing an imide bond;
15 to 35 wt % of a solid lubricant comprising Molybdenum disulfide; and
2 to 7 wt % of a heat-resistant additive comprising Aluminum oxide, the heat-resistant additive dispersed in the resin,
wherein the solid lubrication heat resistant coating is uniformly applied without separation at a temperature between 260° C. and 398° C.

2. The solid lubrication heat resistant coating according to claim 1, wherein the coating is diluted with a solvent and supplied in a varnish form.

3. The solid lubrication heat resistant coating according to claim 1, wherein the coating is formed on an outer surface of an oil-free screw rotor.

4. The solid lubrication heat resistant coating according to claim 1, wherein the coating is formed on outer surfaces of a male rotor and female rotor of an oil-free screw compressor, wherein the oil-free screw compressor sucks and discharges fluid by combining the male rotor and the female rotor on outer surfaces of which spiral profiles are formed in the axis direction.

5. A solid lubrication heat resistant coating comprising:
50 to 70 wt % of a base resin containing an imide bond;
15 to 35 wt % of a solid lubricant comprising Molybdenum disulfide; and
2 to 7 wt % of a heat-resistant additive comprising Titanium oxide, the heat-resistant additive dispersed in the resin,
wherein the solid lubrication heat resistant coating is uniformly applied without separation at a temperature between 260° C. and 398° C.

6. The solid lubrication heat resistant coating according to claim 5, wherein the coating is diluted with a solvent and supplied in a varnish form.

7. The solid lubrication heat resistant coating according to claim 5, wherein the coating is formed on an outer surface of an oil-free screw rotor.

8. The solid lubrication heat resistant coating according to claim 5, wherein the coating is formed on outer surfaces of a male rotor and female rotor of an oil-free screw compressor, wherein the oil-free screw compressor sucks and discharges fluid by combining the male rotor and the female rotor on outer surfaces of which spiral profiles are formed in the axis direction.

9. A solid lubrication heat resistant coating comprising:
50 to 70 wt % of a base resin containing an imide bond;
15 to 35 wt % of a solid lubricant comprising Molybdenum disulfide;
0 to 4 wt % of a heat-resistant additive comprising Silicon nitride; and
a heat-resistant additive comprising Titanium oxide, wherein the heat-resistant additive comprising Titanium oxide and the heat-resistant additive comprising Silicon Nitride are additives dispersed in the resin,
wherein the solid lubrication heat resistant coating is uniformly applied without separation at a temperature between 260° C. and 398° C.

10. The solid lubrication heat resistant coating according to claim 9, wherein the coating is diluted with a solvent and supplied in a varnish form.

11. The solid lubrication heat resistant coating according to claim 9, wherein the coating is formed on an outer surface of an oil-free screw rotor.

12. The solid lubrication heat resistant coating according to claim 9, wherein the coating is formed on outer surfaces of a male rotor and female rotor of an oil-free screw compressor, wherein the oil-free screw compressor sucks and discharges fluid by combining the male rotor and the female rotor on outer surfaces of which spiral profiles are formed in the axis direction.

13. The solid lubrication heat resistant coating according to claim 9, wherein a total additive amount of the heat-resistant additive comprising Silicon nitride and the heat-resistant additive comprising Titanium oxide is 8 to 15 wt %.

14. The solid lubrication heat resistant coating according to claim 13, wherein the coating is diluted with a solvent and supplied in a varnish form.

15. The solid lubrication heat resistant coating according to claim 13, wherein the coating is formed on an outer surface of an oil-free screw rotor.

16. The solid lubrication heat resistant coating according to claim 9, wherein the coating is formed on outer surfaces of a male rotor and female rotor of an oil-free screw compressor, wherein the oil-free screw compressor sucks and discharges fluid by combining the male rotor and the female rotor on outer surfaces of which spiral profiles are formed in the axis direction.

17. A coating varnish, comprising:

50 to 70 wt % of a base resin containing an imide bond;

15 to 35 wt % of a solid lubricant comprising Molybdenum disulfide; and 2 to 7 wt % of a heat-resistant additive comprising Aluminum oxide, the heat-resistant additive dispersed in the resin, wherein the coating varnish is uniformly applied without separation at a temperature between 260° C. and 398° C.

18. An oil-free screw rotor, comprising a coating of:

50 to 70 wt % of a base resin containing an imide bond;

15 to 35 wt % of a solid lubricant comprising Molybdenum disulfide; and 2 to 7 wt % of a heat-resistant additive comprising Aluminum oxide, the heat-resistant additive dispersed in the resin, wherein the coating is uniformly applied to the oil-free screw rotor without separation at a temperature between 260° C. and 398° C.

19. An oil-free screw compressor, comprising a coating of:

50 to 70 wt % of a base resin containing an imide bond;

15 to 35 wt % of a solid lubricant comprising Molybdenum disulfide; and 2 to 7 wt % of a heat-resistant additive comprising Aluminum oxide, the heat-resistant additive dispersed in the resin, wherein the coating is uniformly applied to the oil-free screw compressor without separation at a temperature between 260° C. and 398° C.

* * * * *